United States Patent [19]

Gresser

[11] Patent Number: 4,724,095

[45] Date of Patent: Feb. 9, 1988

[54] ANTI-REDEPOSITION DETERGENT COMPOSITION

[75] Inventor: Robert Gresser, Lyons, France

[73] Assignee: Rhone-Poulenc Chimie de Base, Courbevoie, France

[21] Appl. No.: 737,044

[22] Filed: May 23, 1985

[30] Foreign Application Priority Data

May 23, 1984 [FR] France ..... 84 08009
Apr. 4, 1985 [FR] France ..... 85 05125

[51] Int. Cl.[4] ..... C11D 3/37

[52] U.S. Cl. ..... 252/174.21; 252/174.22; 252/174.23; 252/DIG. 15

[58] Field of Search ..... 252/89.1, 174.21, 174.22, 252/174.23, DIG. 1, DIG. 2, 8.8, DIG. 15; 528/76, 79; 521/905

[56] References Cited

U.S. PATENT DOCUMENTS 4,028,313 6/1977 Muller et al. ..... 521/905
4,068,035 1/1978 Violland et al. ..... 252/DIG. 15
4,201,824 5/1980 Violland et al. ..... 252/174.23
4,347,152 8/1982 Nixon ..... 252/174.21
4,383,079 5/1983 Gasper et al. ..... 521/905
4,493,773 1/1984 Cook et al. ..... 252/174.22

OTHER PUBLICATIONS

Grid, Presenting the Pluronic, Wyandotte Chemical, 1956.

*Primary Examiner*—A. Lionel Clingman
*Assistant Examiner*—Hoa Van Le
*Attorney, Agent, or Firm*—Burns, Doane, Swecker & Mathis

[57] ABSTRACT

A detergent composition adopted for the washing of a fibrous textile substrate, notably a textile substrate comprising fibers of a synthetic organic polymer, includes an anti-redepositon effective amount of at least one hydrophilic/hydrophobic anti-redeposition copolymer which comprises at least one of the recurring units ethylene oxide and alkylene oxide, said copolymer being such as to reduce the zeta potential of the fibers of said textile substrate to a value of 0.5 times or less the zeta potential of the bare fiber content thereof, and said effective amount being such that at least 0.02 mg of said copolymer is adsorbed onto said textile fibers per gram of substrate.

25 Claims, No Drawings

ANTI-REDEPOSITION DETERGENT COMPOSITION

BACKGROUND OF THE INVENTION

1. Field of the Invention

The present invention relates to detergent compositions comprising copolymers based on polyoxyethylene and polyoxyalkylene, which copolymers are useful as anti-redeposition agents in the washing of textile materials.

Such copolymers are more especially useful as anti-redeposition agents in the washing of synthetic, organic and polymeric materials in an aqueous wash medium.

2. Description of the Prior Art

It is known to this art that synthetic, organic and polymeric materials are difficult to clean in an aqueous wash medium. In actual fact, over the course of successive wash operations, the particles of dirt in suspension in the wash medium are definitively and almost irreversibly deposited onto the materials, the consequence being that the textile materials lose their whiteness and their brilliance over time much more markedly that natural textile materials such as cotton.

SUMMARY OF THE INVENTION

Accordingly, a major object of the present invention is the provision of an improved detergent composition which avoids the aforesaid disadvantages and drawbacks to date characterizing the state of the art, which features at least one anti-redeposition copolymer component, and which is particularly useful for washing synthetic organic polymeric materials, said copolymer comprising at least one of the recurring units ethylene oxide and alkylene oxide and which reduces the zeta potential of the textile fiber substrate to a value of less than or equal to 0.5 times the zeta potential of the bare fiber; the subject compositions are used under conditions such that the amount of the anti-redeposition copolymer adsorbed per gram of fabric is at least 0.02 mg.

As utilized hereinafter, the term "zeta potential" is intended to denote the absolute value of that parameter.

DETAILED DESCRIPTION OF THE INVENTION

More particularly according to the present invention, the anti-redeposition copolymer component of the subject compositions advantageously, albeit without limitation thereto, is selected from among four principal types of copolymers.

All preferably have a molecular weight of less than or equal to 150,000 and even more preferably have molecular weights ranging from 2,000 to 150,000 and still more particularly from 4,000 to 100,000.

The copolymers according to the invention preferably comprise an amount by weight of ethylene oxide with respect to the polymer ranging from 10% to 90% and more preferably an amount ranging from 30 to 90% and more particularly an amount ranging from 40 to 70%.

The ethylene oxide groups define the hydrophilic moiety of the copolymer and therefore permit solubilization of the copolymer in water, which is essential for use as a detergent in an aqueous medium. The alkylene oxide groups define the hydrophobic moiety of the copolymers and permit adsorption of the copolymer onto the constituent fibers which comprise synthetic organic polymers. Such adsorption of the copolymer onto such fibers permits the desired result to be achieved, namely, anti-redeposition.

The first group of copolymers which can be used in accordance with this invention comprises copolymers which include straight or branched chain polyoxyethylene and polyoxyalkylene blocks containing, in particular, from 3 to 6 carbon atoms per alkylene group. The alkylene groups are preferably propylene or butylene groups.

Representative such copolymers which are commercially available are those marketed under the registered trademark "Pluronics" and are prepared in known manner, for example, by the process described in U.S. Pat. No. 2,674,619. They are principally and essentially used as polyoxyethylene/polyoxyalkylene copolymer dirt removing agents. To my knowledge, the use of certain of such copolymers, which reduce the zeta potential of the fiber to a value of less than or equal to 0.5 times the zeta potential of the bare fiber, as an anti-redeposition agent has never been disclosed or suggested to this art.

The second group of copolymers which are useful according to this invention comprises copolymers having the following general formula (I):

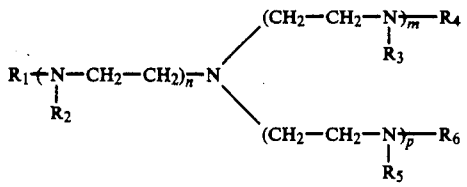

(I)

wherein:

(i) $R_1$, $R_2$, $R_3$, $R_4$, $R_5$ and $R_6$ represent polymers which are branched or straight chain polyoxyethylene and polyoxyalkylene homopolymers containing from 3 to 6 carbon atoms and branched or straight chain polyoxyethylene-polyoxyalkylene block copolymers; and (ii) n, m and p are integers which are equal to or higher than 0 and equal to or lower than 10 and the sum n+m+p of which preferably ranges from 1 to 20 and advantageously from 1 to 5.

It is more particularly preferred to use copolymers in which p=0, m=0 and n=1.

The polyalkylene groups are preferably selected from among polyoxypropylene and polyoxybutylene.

The copolymers of the formula (I) may optionally be ionizable by quaternizing the nitrogen atom or atoms. Such quaternization may be effected, for example, by means of a hydrogen atom or by means of an alkyl group.

Certain of these copolymers are commercially available under the trademark Tetronic.

They have been used in the same fashion as the Pluronics (registered trademark) as dirt removing agents, but have never been used for their anti-redeposition characteristics.

The third group of copolymers which can be used in accordance with the invention comprises copolymers having the following general formula (II):

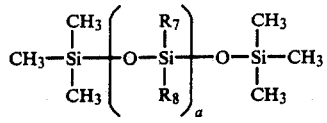

(II)

wherein:

(i) $R_7$ and $R_8$ represent a methyl group or polymers elected from branched or straight chain polyoxyethylene/polyoxyalkylene homopolymers containing in particular from 3 to 6 carbon atoms and branched or straight chain polyoxyethylene/-polyoxyalkylene block copolymers, (ii) a is an integer of from 1 to 150, and (iii) at least one silicon atom bears an $R_7$ and/or $R_8$ substituent.

The commercially available copolymers of formula (II) are prepared in a manner known, per se, as described, for example, in U.S. Pat. No. 2,970,150, Example 16.

The fourth group of copolymers which can be used according to the invention comprises block copolymers including a chain of recurring units having the following general formula (III):

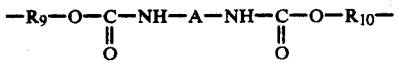

(III)

wherein:

(i) $R_9$ and $R_{10}$ represent polymers selected from among straight or branched chain polyoxyethylene/polyoxyalkylene homopolymers containing in particular from 3 to 6 carbon atoms and branched or straight chain polyoxyethylene-polyoxyalkylene block copolymers, wherein each of the groups $R_9$ and $R_{10}$ may be different from one unit to another, and (ii) A represents an alkylene or phenylene radical, or an optionally substituted such radical.

The polyoxyalkylenes are preferably polyoxypropylenes.

Among the copolymers of formula (III), representative are those in which A represents a hexamethylene, toluylene, isophorone or diphenylalkane radical.

It is more particularly preferred to employ those copolymers of the formula (III) wherein A is a hexamethylene or toluylene radical.

According to the invention, among the copolymers of group 4, it is preferred to use those which have: a molecular weight of from 4,000 to 40,000 and more particularly from 4,000 to 25,000, an amount by weight of ethylene oxide which ranges from 40 to 50%, polyoxyethylene sequences having molecular weights of less than 3,500 and even more preferably from 550 to 1,600, and polyoxyalkylene sequences having molecular weights of less than 4,000 and preferably from 500 to 2,000.

The copolymers of formula (III) are produced, for example, by condensation of polyoxyethylene and polyoxyalkylene or polyoxyethylene-polyoxyalkylene copolymers, as defined with respect to the first group of copolymers according to the invention, with diisocyanates selected from among hexamethylene diisocyanate, toluylene diisocyanate, isophorone diisocyanate, di(isocyanatophenyl) alkanes, in an anhydrous medium and in the presence of tin salt.

The copolymers produced by condensation of the homopolymers with diisocyanates have markedly improved anti-redeposition properties.

The aforedescribed copolymers can be used according to the invention as anti-redeposition agents when they reduce the zeta potential of the textile fiber substrate to a value of less than or equal to 0.5 times the zeta potential of the bare fiber. That reduction in zeta potential depends upon the amount of copolymer adsorbed. That amount must be higher than 0.02 mg/g.

The amount adsorbed is measured by contacting a sample of fabric of synthetic, organic polymeric material (type Tergal: registered trademark), having a weight of about 3.5 g and fixed onto a metal carrier, with 100 ml of a solution of NaCl (3 g/l) containing the polymer, in a cell which is thermostatically controlled at 25° C. The medium is agitated. When the adsorption equilibrium condition is attained, the amount adsorbed is ascertained by quantitative determination of the concentration of polymer remaining in solution in accordance with the method described by Baleux [*C. R. Acad. Sc.*, 274 series C, 1617 (1972)].

The zeta potential of the fiber is measured both before and after contact with the copolymer.

The measurements in respect of zeta potential or electrokinetic potential are carried out by the flow potential method: a solution of NaCl of 3 g/l (pH=7) which does or does not contain the polymer flows under the influence of a pressure through a pad formed of a plurality of superposed discs of fabric. The variation in the potential difference at the ends of the pad in dependence on the pressure applied to the solution makes it possible to determine the zeta potential of the fibers [J. S. Stanley, *J. Phys. Chem.*, 58, 533 (1954)].

Before measuring the electrokinetic potential, the discs of fabric are contacted for a period of 24 hours with a solution of polymer in a NaCl medium (3 g/l) such as to adsorb the copolymer onto the fibers. After the adsorption phase, the fabric discs are placed in the filter of the apparatus and the copolymer solution used in the course of the adsorption period flows through the fabric pad under the influence of pressure.

Operation is in the same manner with fabric discs which are not impregnated with the copolymer.

The anti-redeposition effects of the copolymer may be measured by a series of different tests in the presence of dirt.

It was completely unexpected vis-a-vis the prior art that the effectiveness of the copolymer and particularly its anti-redeposition activity is linked to, or associated with, the zeta potential of the synthetic, organic, polymeric material fiber onto which the copolymer is adsorbed.

It was surprisingly discovered consistent herewith that the anti-redeposition effect was produced when the zeta potential of the fiber onto which the copolymer is adsorbed is equal to or less than 0.5 times that of the bare or untreated fiber.

That reduction in zeta potential is achieved with amounts of adsorbed copolymer which are equal to or higher than 0.02 mg/g of fabric. The preferred amount of adsorbed copolymer varies with the type of copolymer adsorbed.

For copolymers of the first group, comprised of polyoxyethylene and polyoxyalkylene copolymers, the preferred amount of adsorbed copolymer ranges from 0.1 to 5 mg/g of fabric.

For copolymers of the second group, having the general formula (I), the preferred amount of copolymer adsorbed ranges from 0.02 to 5 mg/g of fabric.

For copolymers of the third group, having the general formula (II), the preferred amount of adsorbed copolymer is higher than about 0.3 mg/g and even more preferably ranges from 0.4 to 5 mg/g of fabric.

For the copolymers of the fourth group, having the general formula (III), the preferred amount of adsorbed copolymer ranges from 0.05 to 5 mg/g of fabric.

The subject detergent compositions may otherwise include the typical detergent additives, e.g., detergent builders, surfactants, optical whiteners, etc.

In order to further illustrate the present invention and the advantages thereof, the following specific examples and anti-redeposition tests are given, it being understood that same are intended only as illustrative and in nowise limitative.

ANTI-REDEPOSITION TESTS

Test No. 1

Using a cell which was thermostatically controlled at 25° C. and which contained 100 ml of a solution of NaCl (3 g/l) and a concentration of 50 mg/l of anti-redeposition agent, 5 ml of a suspension of carbon black ("Printex U" [registered trademark] black, concentration of 200 mg/l) which had been previously dispersed by ultrasound and a sample of fabric (polyester of type Tergal, m~0.5 g) which was fixed onto a metal carrier were successively introduced into the cell. Agitation of the medium was effected by a magnetic stirrer bar.

After a contact time of 30 minutes, the carrier bearing the sample of fabric was withdrawn and immersed in 100 ml of distilled water which was agitated by means of a magnetic stirrer bar. The rinsing operation was for 3 minutes.

Deposition onto the textile fibers was evaluated by the difference ΔR (as measured by a "Elrepho" photometer from Zeiss [registered trademark], filter No. 10) between the reflectance of the initially clean fabric and that of the fabric after contact with the carbon black suspension.

The higher value of ΔR, the greater the magnitude of deposition. In the absence of copolymer, the value of ΔR was 40. It is considered that an anti-redeposition additive has a high level of efficiency over the course of that test, if it reduces ΔR to a value of from 10 to 18; below 10, the levels of performance of the additive are excellent.

Test No. 2

The anti-redeposition effectiveness of an additive was evaluated by carrying out five cumulative washing cycles in a "Terg-O-Tometer" (United States Testing Company Inc., Hobokin, NJ), in the presence of a "complete" stain.

Each cycle constituted a 20 minute washing phase (1 l of solution per pot, T=60° C.), and a five minute rinsing operation in cold hard water. The staining material was introduced into each pot, five minutes after the beginning of each cycle. The degree of hardness of the water used was 32° H.T.

The staining material used was of the "Spangler" type [W. G. Spangler, H. D. Cross and B. R. SCHAAFSMA, *J. Am. Oil Chemist's Soc.*, 42,723 (1965)] and comprised:

(1) 100 g Sebum;
(2) 4 g Oleic acid;
(3) 8 g Triethanolamine;
(4) 4 g Particular staining material; and
(5) 884 g Water The composition of the sebum was as follows:

(i) 10% Palmitic acid;
(ii) 5% Technical stearic acid;
(iii) 10% Purified oleic acid;
(iv) 5% Linoleic acid;
(v) 15% Coconut oil;
(vi) 20% Pure olive oil;
(vii) 5% of 90% Squalene;
(viii) 10% 52/54 Refined paraffin;
(ix) 15% Spermaceti; and
(x) 5% Cholesterol The composition of the particular staining matter was as follows:

(i) 86% Kaolin;
(ii) 8% Lamp black;
(iii) 4% Black iron oxide; and
(iv) 2% Yellow iron oxide The total concentration of the staining material was 50 g/l for each washing cycle.

The concentration of lye was 6 g/l, and its composition by weight was as follows:

(i) Straight chain sodium alkylbenzene sulphonate: 7.5%
(ii) Sodium stearate: 3%
(iii) Straight chain ethoxylated $C_{18}$ alcohol with 12 moles of ethylene oxide: 3%
(iv) Straight chain ethoxylated $C_{18}$ alcohol with 50 moles of ethylene oxide: 2%
(v) Sodium Tripolyphosphate: 27.5%
(vi) Anhydrous sodium pyrophosphate: 2%
(vii) Anhydrous trisodium phosphate: 0.5%
(viii) 3 Na powder silicate: 8.6%
(ix) Carboxymethylcellulose: Blanose BWS (registered trademark): 1.5%
(x) Tinopal SOP (registered trademark): 0.2%
(xi) Tinopal DMSX (registered trademark): 0.2%
(xii) Esperase NOVO (registered trademark): 0.3%
(xii) Perborate: 25%
(xiv) Magilex 120 (registered trademark): 1%
(xv) EDTA: 0.2%
(xvi) Sodium sulphate: 17.5%

The samples of fabric used over the course of the washing tests were samples of polyester ("Dacron 54" [registered trademark] from Testfabric) which were pre-washed at 60° C. in a machine fed with soft water and without detergent. Each pot of the "Terg-O-Tometer" contained 6 rectangles of fabric (10×12 cm).

The concentration of anti-redeposition additive used was 50 mg/l. Redeposition was quantified by the difference ΔR (as measured by a Gardner [registered trademark] photometer, filter Y) between the reflectance of the initially clean fabric and that of the fabric after five washing cycles. The lower the value of ΔR, the higher the effectiveness of the anti-redeposition agent.

Test No. 3

The experimental conditions over the course of this test were identical to those of the preceding test, except that the staining material no longer was a liquid stain of the "Spangler" type, but a staining material which was impregnated onto samples of cotton (WFK Testgewebe GmbH Krefeld"). Before each washing cycle, three rectangles (10×12 cm) of dirty cotton were introduced into each pot.

For tests Nos. 2 and 3, it was considered that an additive had a significant anti-redeposition effect if the value of ΔR was reduced by at least 3 points in the presence of the polymer in comparison with the value of ΔR as measured in the absence of an additive.

The values of the ratio $\xi/\xi_o$ ($\xi$ is the zeta potential of the fiber in the presence of copolymer and $\xi_o$ represents the zeta potential of the bare fiber) and the amount adsorbed per gram of fabric, as indicated in the following Examples, were determined under conditions wherein the amount adsorbed was close to its maximum value, which corresponded, under the experimental conditions used, to concentrations of copolymer within the solution on the order of 10 mg/l.

EXAMPLES 1 TO 10

Copolymers of Group 1

Table 1 reports the results of the anti-redeposition effect (ΔR) as measured in accordance with Test 1 of copolymers which are commercially available under the registered trademark Pluronics. The substsances in respect of which the ratio $\xi/\xi_o$ was lower than 0.50 (Examples 1, 2, 3 and 5) had an anti-redeposition effect which was markedly improved in comparison with those which did not comply with the criteria of the invention. Example 6 demonstrated, in particular, that Pluronic L 64 which is known to have good stain removing capacity does exhibit the criteria of the invention.

EXAMPLES 11 TO 18

Copolymers of Group 2

Examples 11 to 16 were carried out with copolymers which comprised ethoxypropylated ethylene diamines, in accordance with the general formula (I) wherein n=1, m=p=o and $R_1=R_4=R_6=(C_3H_6O)_x(C_2H_4O)_yH$. Such copolymers are marketed under the trademark Tetronic. Tests 11, 12, 15 and 16 were in accordance with the invention.

Example 17 was carried out using a copolymer corresponding to general formula (I) wherein n=1, m=p=O, $R_1=R_2=R_4=R_6=(C_3H_6O)_x(C_2H_4O)_yH$, commercially available under the registered trademark Lutensol; it was in accordance with the invention.

Example 18 was carried out using an ethoxypropylated triethylenetetramine, corresponding to general formula (I) wherein n=m=p=1, $R_1=R_2=R_3=R_4=R_5=R_6=(C_3H_6O)_x\ (C_2H_4O)_yH$; it also was in accordance with the invention.

The results of Tests 11 to 18 are reported in Table 2.

It was found that copolymers which had a ratio $\xi/\xi_o$ of less than 0.5 exhibited an anti-redeposition property which was greatly improved in comparison with those which did not correspond to the criteria of the invention.

EXAMPLE 19

Copolymer of Group 3

Example 19 was carried out using a copolymer having the general formula (II), wherein a=12 and which comprised 4 ethylene oxide homopolymers having a molecular weight of 550.

The results of Test 19 are reported in Table 3.

Table 3 demonstrates that the value of the ratio $\xi/\xi_o$ obtained in the presence of the aforesaid copolymer was 0.4 for an adsorbed amount of 0.44 mg of copolymer per gram of fabric, which gave a high level of anti-redeposition effectiveness (ΔR=15.1). Such copolymer, therefore, is suited for the purpose of the invention.

EXAMPLES 20 to 59

Copolymers of Group 4

Examples 20 to 33 were carried out using copolymers produced by condensation of copolymers of Group 1, Pluronics (registered trademark) with hexamethylene diisocyanate (HDI) at a temperature of from 80° to 105° C. in the optional presence of a catalyst such as dibutyltin dilaurate. The results of Tests 20 to 33 are reported in Table 4a.

These copolymers had excellent anti-redeposition activity and gave values of the ratio $\xi/\xi_o$ which were lower than 0.5. They were suited for the purposes of the invention.

Examples 34 to 58 were carried out using copolymers produced by condensation of polyoxyethylene and polyoxyalkylene in the presence of hexamethylene diisocyanate. The results of Tests 34 to 58 are reported in Tables 4b, 4c and 4d.

It was noted that particularly good results were obtained using copolymers which constituted an amount by weight of ethylene oxide ranging from 40 to 50% and a molecular weight of from 4,000 to 25,000. That was the case in Tests 38, 39, 40, 54 and 55.

The invention also features the preparation of detergent compositions comprising the copolymers of the above-described type, a simple and effective preparative process now having been developed.

The process for the preparation of detergent compositions according to the invention is characterized in that the anti-redeposition copolymer is added to a slurry containing the other constituents of the subject compositions, and thence drying the admixture produced.

It has been found that the copolymer introduced in such manner retains all of its desired properties in the composition. That is an attractive advantage, as the copolymers of the invention may be used without substantially modifying the conventional processes for the preparation of detergent compositions.

Preparations of the slurry is carried out in manner known per se. The copolymer is added thereto under agitation and the resulting mixture is then dried using any suitable means.

Any conventional additive which is used in conventional detergent compositions, such as bleaching agents, anti-foam ingredients, perfumes, coloring agents and enzymes may be mixed with the dry product which is produced in the above-indicated manner.

The amount of copolymer added is such that is represents about 0.2 to 5% and preferably from 1 to 2% by weight of the final composition.

Upon being added to the slurry, the copolymer may be present in different forms.

A first embodiment is for the copolymer to be present in the form of a solution in water. In such a case, the concentration of copolymer in the solution ranges from 5 to 20% and preferably from 10 to 15%.

Another embodiment comprises preparing a solution of the copolymer in a water-alcohol mixture.

The alcohol selected may be an aliphatic alcohol, such as, for example, ethanol, or else a compound which can be used in detergents as a non-ionic surface active agent, such as, for example, polyoxyethylenated alkylphenols, polyoxyethylenated aliphatic alcohols, glycols and polyglycols.

Generally, the mixture contains 40 to 60% of copolymer, 20 to 50% of water and 5 to 15% of alcohol, preferably 50% of copolymer, 40% of water and 10% of alcohol.

It is also possible for the copolymer to be incorporated onto a carrier. In that case, the carrier may be a suitable silica, such as, for example, a silica of type Tixosil 38A.

Moreover, it is also envisaged to use mixtures of the copolymer and sulfonic acids, such as, for example, arylsulfonic, alkylsulfonic and alkylarylsulfonic acids, in particular straight-chain sulfonic alkylbenzenes.

One example of such a composition according to the invention follows.

The various constituents of the composition are set forth below, with their percentages by weight.

(i) Straight chain sodium alkylbenzene sulfonate: 7%
(ii) Sodium stearate: 3%
(iii) Straight chain ethoxylated $C_{18}$ alcohol with 12 moles of ethylene oxides: 3%
(iv) Straight chain ethoxylated $C_{18}$ alcohol with 50 moles of ethylene oxide: 2%
(v) Sodium tripolyphosphate: 27.5%
(vi) Sodium pyrophosphate: 2%
(vii) Sodium orthophosphate: 0.5%
(viii) Sodium silicate: 8.6%
(ix) Sodium sulfate: 24.5%
(x) Carboxymethylcellulose: Blanose BWS: 1.5%
(xi) TINOPAL SOP (registered trademark): 0.2%
(xii) TINOPAL DMSX (registered trademark): 0.2%
(xiii) Esperase NOVO (registered trademark): 0.3%
(xiv) Perborate: 15%
(xv) TAED (57% of active matter): 3.5%
(xvi) Magilex 120 (registered trademark): 1%
(xvii) EDIA: 0.2%

A slurry comprising the sodium alkylbenzene sulfonate and the sodium sulfate, stearate, silicate and tripolyphosphate was first prepared, under agitation for 20 minutes at 85° to 90° C.

The operating procedure then differed, according to 3 cases.

CASE 1

In the first case, no anti-redeposition agent according to the invention was added to the formulation. The slurry was then dried for 4 hours at 150° C. and then mixed with the other constituents of the composition.

CASE 2

This case included adding an anti-redeposition agent according to the invention, in the form of a 10% solution in water, under agitation, for a period of 15 minutes, at 80° C. This agent is the copolymer set forth in Example 39 (copolymer produced by condensation of polyoxyethylene and polyoxyalkylene in the presence of hexamethylene diisocyanate).

The resulting slurry was mixed after drying (4 hours at 150° C.) with the other components of the composition.

CASE 3

In this case, an anti-redeposition agent was also not added, and the procedure followed was as in the first case. However, the same agent as that used in Case 2 was added to the wash medium before each wash cycle.

The washing operations were then carried out, followed by relfectance measurements, under the conditions set forth in Test 3.

In Cases 2 and 3, the amount of anti-redeposition agent constituted 1% of the total weight of the composition. The concentration of the wash composition was 6 g/l.

The reflectance Ry of the textile after the washing operations was evaluated. The higher the degree of reflectance Ry, the lower the degree of redeposition. The results are set forth below:

| | Ry |
|---|---|
| Case 1 | 62.5 |
| Case 2 | 80.6 |
| Case 3 | 79.4 |
| Textile not stained before washing: | 83 |

It will therefore be seen, by comparing Cases 2 and 3, that the anti-redeposition agent according to the invention can thus be completely incorporated into a slurry without any noticeable influence on its properties.

Obviously, it will be appreciated that the preparation process immediately above described is only one particular and advantageous process, and other processes for the preparation of the above subject compositions can be employed without departing from the scope of this invention.

TABLE 1

| Examples | PLURONICS | Mass of the polyoxypropylene sequence | Ethylene oxide % | Molecular weight | Anti-redeposition test | ΔR | $\xi/\xi_o$ | Amount adsorbed mg/g |
|---|---|---|---|---|---|---|---|---|
| 1 | F 108 | 3,250 | 80 | 16,200 | 1 | 3.9 | 0.11 | 0.17 |
| 2 | F 88 | 2,250 | 80 | 11,200 | 1 | 7.8 | 0.28 | 0.12 |
| 3 | F 68 | 1,750 | 80 | 8,700 | 1 | 15.8 | 0.43 | 0.03 |
| 4 | F 38 | 950 | 80 | 4,700 | 1 | 33.3 | 0.90 | 0.02 |
| 5 | p 105 | 3,250 | 50 | 6,500 | 1 | 8.4 | 0.46 | 0.11 |
| 6 | L 64 | 1,750 | 40 | 2,900 | 1 | 31.9 | 0.95 | 0.03 |
| 7 | p 85 | 2,250 | 50 | 4,500 | 1 | 21.9 | 0.58 | 0.08 |
| 8 | p 75 | 2,050 | 50 | 4,100 | 1 | 22.4 | 0.63 | 0.07 |
| 9 | L 42 | 1,200 | 20 | 1,500 | 1 | 38.9 | 0.97 | 0.03 |
| 10 | without additive | | | | 1 | 40 | 1 | 0 |

Results obtained with the copolymers of Group 1

TABLE 2

| Examples | Substances | Mass of the polyoxypropylene sequence | Ethylene oxide % | Molecular weight | Anti-redeposition test | ΔR | $\xi/\xi_o$ | Amount adsorbed mg/g |
|---|---|---|---|---|---|---|---|---|
| 10 | without additive | | | | 1 | 40 | 1 | 0 |
| 11 | TETRONIC 1301 | 5,750 | 10 | 6,400 | 1 | 10 | 0.31 | 0.15 |
| 12 | TETRONIC 1302 | 5,750 | 20 | 7,200 | 1 | 9.3 | 0.27 | 0.17 |
| 13 | TETRONIC 701 | 2,750 | 10 | 3,000 | 1 | 40 | 0.95 | 0.01 |
| 14 | TETRONIC 704 | 2,750 | 40 | 4,600 | 1 | 38.4 | 0.88 | 0.02 |
| 15 | TETRONIC 904 | 3,750 | 40 | 6,200 | 1 | 17.2 | 0.44 | 0.12 |
| 16 | TETRONIC 908 | 3,750 | 80 | 18,700 | 1 | 6.1 | 0.22 | 0.15 |
| 17 | LUTENSOL ED 370 | 3,000 | 70 | 10,000 | 1 | 12.6 | 0.30 | 0.13 |
| 18 | Ethoxypropylated triethylene tetramine | 5,000 | 80 | 25,000 | 1 | 2.3 | 0.37 | 0.08 |

Results obtained with the copolymers of Group 2

TABLE 3

| Example | Substance | Ethylene oxide % | Molecular weight | Anti-redeposition test | ΔR | $\xi/\xi_o$ | Amount adsorbed mg/g |
|---|---|---|---|---|---|---|---|
| 19 | Polysiloxane | 70 | 3,000 | 1 | 15.1 | 0.4 | 0.44 |

Results obtained with the copolymers of Group 3

TABLE 4a

| Examples | Substances used in preparation of the additive: Starting Pluronic | Mass of HDI for 200 g of polymer | Ethylene oxide % | Anti-redeposition test | ΔR | $\xi/\xi_o$ | Amount adsorbed mg/g |
|---|---|---|---|---|---|---|---|
| 20 | without additive | | | 2 | 46 | 1 | 0 |
| 21 | without additive | | | 3 | 30 | 1 | 0 |
| 22 | F 108 | 5 | 80 | 2 | 29 | 0.23 | 0.15 |
| 23 | F 108 | 7 | 80 | 2 | 26 | 0.10 | 0.20 |
| 24 | F 108 | 5 | 80 | 3 | 16.3 | 0.23 | 0.15 |
| 25 | F 108 | 7 | 80 | 3 | 6.4 | 0.10 | 0.20 |
| 26 | F 68 | 5 | 80 | 2 | 41 | 0.40 | 0.07 |
| 27 | F 68 | 7 | 80 | 2 | 42 | 0.45 | 0.05 |
| 28 | F 68 | 5 | 80 | 3 | 10.6 | 0.40 | 0.07 |
| 29 | F 68 | 7 | 80 | 3 | 8 | 0.45 | 0.05 |
| 30 | p 103 | 10 | 30 | 2 | 28 | 0.18 | 0.32 |
| 31 | p 103 | 17 | 30 | 2 | 27 | 0.25 | 0.28 |
| 32 | p 103 | 10 | 30 | 3 | 4 | 0.18 | 0.32 |
| 33 | p 103 | 17 | 30 | 3 | 10.5 | 0.25 | 0.28 |

Results obtained by means of products prepared by condensation of the copolymers of Group 1

TABLE 4b

| EX | Nature and amount of the substances involved in the condensation reactions: Mass of the polyoxyethylene sequences | Mass of the polyoxypropylene sequences | Mass of HDI | Ethylene oxide % | Molecular weight | Test | ΔR | $\xi/\xi_o$ | Amount adsorbed mg/g |
|---|---|---|---|---|---|---|---|---|---|
| 34 | PEG(600) 60 g PEG(1500) 150 g | PPG(1000) 50 g | 37.8 | 70 | 12,000 | 3 | 14.3 | 0.32 | 0.09 |
| 35 | PEG(600) 30 g PEG(3400) 170 g | PPG(1000) 50 g | 22.7 | 73 | 18,000 | 3 | 18.2 | 0.39 | 0.08 |
| 36 | PEG(8000) 160 g | PPG(1000) 40 g | 9.1 | 76 | 40,000 | 3 | 11.5 | 0.34 | 0.12 |
| 37 | PEG(8000) 160 g | PPG(2000) 40 g | 6.1 | 78 | 50,000 | 3 | 13.3 | 0.41 | 0.15 |
| 38 | PEG(600) 120 g | PPG(1000) 100 g | 45.4 | 45 | 9,000 | 3 | 5.5 | 0.10 | 0.32 |
| 39 | PEG(600) 30 g PEG(1500) 75 g | PPG/1000) 100 g | 30.2 | 45 | 12,000 | 3 | 2 | 0.08 | 0.35 |
| 40 | PEG(1500) 150 g | PPG(1000) 50 g PPG(2000) 100 g | 30.2 | 45 | 17,000 | 3 | 5 | 0.09 | 0.30 |
| 41 | PEG(600) 18 g PEG(3400) 102 g | PPG(2000) 120 g | 18.1 | 46 | 25,000 | 3 | 5.2 | 0.12 | 0.28 |
| 42 | PEG(600) 18 g PEG(3400) 102 g | PPG(4000) 120 g | 13.6 | 47 | 29,000 | 3 | 9 | 0.24 | 0.25 |
| 43 | PEG(3400) 102 g | PPG(4000) 120 g | 9.1 | 44 | 40,000 | 3 | 16.8 | 0.40 | 0.18 |
| 44 | PEG(8000) 160 g | PPG(4000) 160 g | 9.1 | 49 | 57,000 | 3 | 12.7 | 0.35 | 0.22 |
| 45 | PEG(600) 60 g PEG(1500) 150 g | PPG(1000) 100 g | 45.4 | 60 | 12,000 | 3 | 7.8 | 0.18 | 0.20 |

Results obtained by means of the copolymers prepared by condensation of polyoxyethylene and polyoxypropylene TABLE 4c

| EX | Nature and amount of the substances involved in the condensation reactions: Mass of the polyoxyethylene sequences | Mass of the polyoxypropylene sequences | Mass of HDI | Ethylene oxide % | Molecular weight | Test | ΔR | $\xi/\xi_o$ | Amount adsorbed mg/g |
|---|---|---|---|---|---|---|---|---|---|
| 46 | PEG(1500) 150 g | PPG(1000) 75 g | 26.5 | 60 | 14,000 | 3 | 10 | 0.25 | 0.22 |
| 47 | PEG(600) 30 g PEG(3400) 170 g | PPG(2000) 100 g | 22.7 | 62 | 22,000 | 3 | 11.7 | 0.23 | 0.19 |

TABLE 4c-continued

| EX | Nature and amount of the substances involved in the condensation reactions: Mass of the polyoxyethylene sequences | Mass of the polyoxypropylene sequences | Mass of HDI | Ethylene oxide % | Molecular weight | Test | ΔR | $\xi/\xi_o$ | Amount adsorbed mg/g |
|---|---|---|---|---|---|---|---|---|---|
| 48 | PEG(3400) 170 g | PPG(2000) 85 g | 14.0 | 63 | 29,000 | 3 | 18 | 0.24 | 0.18 |
| 49 | PEG(8000) 160 g | PPG(2000) 80 g | 9.1 | 64 | 40,000 | 3 | 8.5 | 0.14 | 0.25 |
| 50 | PEG(8000) 160 g | PPG(4000) 80 g | 6.1 | 65 | 57,000 | 3 | 14.5 | 0.30 | 0.15 |

PEG = polyethyleneglycol
PPG = polypropyleneglycol
Results obtained by means of copolymers prepared by the condensation of polyoxyethylene and polyoxypropylene TABLE 4d

| EX | Nature and amount of the substances involved in the condensation reactions: Mass of the polyoxyethylene sequences | Mass of the polyoxypropylene sequences | Mass of HDI | Ethylene oxide % | Molecular weight | Test | ΔR | $\xi/\xi_o$ | Amount adsorbed mg/g |
|---|---|---|---|---|---|---|---|---|---|
| 51 | PEG(600) 60 g PEG(1500) 150 g | PTHF(1000) 50 g | 37.8 | 70 | 12,000 | 3 | 10 | 0.20 | 0.12 |
| 52 | PEG(600) 30 g PEG(3400) 170 g | PTHF(1000) 50 g | 22.7 | 73 | 18,000 | 3 | 18.3 | 0.12 | 0.08 |
| 53 | PEG(8000) 160 g | PTHF(1000) 40 g | 9.1 | 76 | 40,000 | 3 | 7.8 | 0.17 | 0.09 |
| 54 | PEG(600) 120 g | PTHF(1000) 100 g | 45.4 | 45 | 9,000 | 3 | 4 | 0.18 | 0.30 |
| 55 | PEG(600) 30 g PEG(1500) 75 g | PTHF(1000) 100 g | 30.2 | 45 | 12,000 | 3 | 1 | 0.12 | 0.35 |
| 56 | PEG(8000) 160 g | PTHF(1000) 160 g | 27.2 | 46 | 18,000 | 3 | 11 | 0.22 | 0.34 |
| 57 | PEG(600) 60 g PEG(1500) 150 g | PTHF(1000) 100 g | 45.4 | 59 | 12,000 | 3 | 8.2 | 0.21 | 0.28 |
| 58 | PEG(600) 30 g PEG(3400) 170 g | PTHF(1000) 100 g | 30.2 | 61 | 17,000 | 3 | 9.1 | 0.25 | 0.22 |

PTHF = polytetrahydrofuran
Results obtained by means of copolymers prepared by condensation of polyoxyethylene and polytetrahydrofuran (polyoxybutylene)

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A detergent composition adapted for the washing of a fibrous textile substrate, said composition comprising at least one hydrophilic/hydrophobic anti-redeposition copolymer in a detergent composition which comprises at least one of the recurring units ethylene oxide as the hydrophilic moiety and alkylene oxide as the hydrophobic moiety, said copolymer having the following formula:

$$-R_9-O-\underset{\underset{O}{\|}}{C}-NH-A-NH-\underset{\underset{O}{\|}}{C}-O-R_{10}- \qquad \text{(III)}$$

wherein $R_9$ and $R_{10}$ represent branched or straight chain polyoxyethylene and polyoxyalkylene homopolymers containing from 3 to 6 carbon atoms, or branched or straight chain polyoxyethylene-polyoxyalkylene copolymers, and A represents a substituted or unsubstituted alkylene or phenylene radical, said copolymer being present in the detergent composition in an amount effective to result in adsorption per gram of substrate of at least 0.02 mg of said copolymer onto said textile fibers, said copolymer characterized in that it can reduce the zeta potential of the fibers of said textile substrate to a value of 0.5 times or less the zeta potential of the bare fiber content thereof.

2. The detergent composition as defined by claim 1, said polyoxyalkylene copolymers comprising polyoxypropylene copolymers.

3. The detergent composition as defined by claim 1, said at least one copolymer having a molecular weight ranging from 4,000 to 25,000.

4. The detergent composition as defined by claim 1, said at least one copolymer comprising an amount by weight of ethylene oxide ranging from 40 to 50%.

5. The detergent composition as defined by claim 4, said at least one copolymer comprising polyoxyethylene sequences having a molecular weight from 550 to 3,500.

6. The detergent composition as defined by claim 1, said at least one copolymer comprising polyoxyalkylene sequences having a molecular weight from 500 to 4,000.

7. The detergent composition as defined by claim 1, said effective amount of said at least one copolymer being such that from 0.05 to 5 mg thereof is adsorbed onto said textile fibers per grams of substrate.

8. The detergent composition as defined by claim 1, further comprising a detergent builder.

9. The detergent composition as defined by claim 8, further comprising a surface active agent.

10. A process for washing a fibrous textile substrate, comprising adding a composition comprising at least one hydrophilic/hydorphobic anti-redeposition copolymer in a detergent composition to an aqueous medium containing textile fibers, in an amount sufficient to result in adsorption per gram of substrate of at least 0.02 mg of said copolymer onto said textile fibers, which copolymer comprises at least one of the recurring units ethylene oxide as the hydrophilic moiety and alkylene oxide as the hydrophobic moiety, said polymer having the following formula:

$$R_9-O-\underset{\underset{O}{\|}}{C}-NH-A-NH-\underset{\underset{O}{\|}}{C}-O-R_{10}$$

wherein $R_9$ and $R_{10}$ represent branched or straight chain polyoxyethylene and polyoxyalkylene homopolymers containing from 3 to 6 carbon atoms or branched or straight chain polyoxyethylene-polyoxyalkylene copolymers and A represents a substituted or unsubstituted alkylene or phenylene radical, said copolymer characterized in that it can reduce the zeta potential of the fibers of said textile substrate to a value of 0.5 times or less the zeta potential of the bare fiber content thereof.

11. The process of claim 10, wherein said polyoxyalkylene copolymers comprise polyoxypropylene copolymers.

12. The process of claim 10, wherein said at least one copolymer has a molecular weight ranging from 4,000 to 25,000.

13. The process of claim 10, wherein said at least one copolymer comprises an amount by weight of ethylene oxide ranging from 40 to 50%.

14. The process of claim 13, wherein said at least one copolymer comprises polyoxyethylene sequences having a molecular weight of from 550 to 3,500.

15. The process of claim 10, wherein said at least one copolymer comprises polyoxyalkylene sequences having a molecular weight of from 500 to 4,000.

16. The process of claim 10, said effective amount of said at least one copolymer being such that from 0.05 to 5 mg thereof is adsorbed onto said textile fibers per gram of substrate.

17. The process of claim 10, further comprising initially adding said anti-redeposition copolymer to a slurry of the other constituents of said composition and thence drying the resulting admixture.

18. The process of claim 17, wherein said copolymer is added to the slurry in the form of an aqueous solution thereof.

19. The process of claim 17, wherein said copolymer is added to the slurry in the form of a water/alcohol solution thereof.

20. The process of claim 19, said alcohol comprising a non-ionic surface active agent.

21. The process of claim 17, said copolymer being affixed to a silica carrier.

22. The process of claim 17, comprising adding said copolymer in admixture with a sulfonic acid.

23. The detergent composition of claim 10, comprising a detergent builder.

24. The process of claim 10 wherein the detergent composition further comprises a surface active agent.

25. The process of claim 10 wherein the textile substrate comprises fibers of a synthetic organic polymer.

* * * * *